US005505421A

United States Patent [19]

Marthaler

[11] Patent Number: 5,505,421

[45] Date of Patent: Apr. 9, 1996

[54] PORTABLE PAPER SHEET COPYHOLDER

[75] Inventor: Robert H. Marthaler, Bartlett, Ill.

[73] Assignee: Acco U.S.A., Inc., Wheeling, Ill.

[21] Appl. No.: 371,181

[22] Filed: Jan. 11, 1995

[51] Int. Cl.[6] ..... B41J 11/02

[52] U.S. Cl. ..... 248/442.2; 248/918

[58] Field of Search ..... 248/442.2, 452, 248/473, 918, 441.1; 400/718

[56] References Cited

U.S. PATENT DOCUMENTS

| | | | |
|---|---|---|---|
| D. 327,501 | 6/1992 | Maloney . | |
| D. 327,502 | 6/1992 | Maloney . | |
| 1,681,586 | 8/1928 | Kessler | 248/441.1 X |
| 1,829,360 | 10/1931 | Lambert | 248/473 |
| 4,074,453 | 2/1978 | Knox . | |
| 4,125,243 | 11/1978 | Liptak | 248/473 |
| 4,767,093 | 8/1988 | Jones | 248/452 X |
| 4,836,489 | 6/1989 | Chu | 248/442.2 |
| 4,902,078 | 2/1990 | Judd . | |
| 4,960,257 | 10/1990 | Waters . | |
| 5,044,593 | 9/1991 | Jones | 248/442.2 |
| 5,067,681 | 11/1991 | Huang et al. . | |
| 5,104,088 | 4/1992 | Bakanowsky | 248/918 X |
| 5,125,612 | 6/1992 | McNeal . | |
| 5,161,767 | 11/1992 | Hansen . | |
| 5,292,099 | 3/1994 | Isham et al. . | |
| 5,297,768 | 3/1994 | Denton . | |
| 5,301,915 | 4/1994 | Bahniuk | 248/452 |

FOREIGN PATENT DOCUMENTS

| | | | |
|---|---|---|---|
| 650290 | 9/1936 | Germany | 248/473 |

*Primary Examiner*—J. Franklin Foss
*Attorney, Agent, or Firm*—Pennie & Edmonds

[57] ABSTRACT

A copyholder for mounting on a surface having a base for mounting and pivotal paper holding means comprised of two opposed curved portions forming a paper-receiving channel. The curved portions may have s-shapes.

8 Claims, 5 Drawing Sheets

PORTABLE PAPER SHEET COPYHOLDER

BACKGROUND OF THE INVENTION

Paper holders using curved holding surfaces have been proposed (U.S. Pat. No. 4,074,453). Copyholders attachable to computer monitors have also been disclosed using hook and loop fasteners (U.S. Pat. Nos. 5,292,099; 4,902,078; and U.S. Pat. No. Design 327,501).

None of the prior holders have provided a compact versatile holding arrangement as herein disclosed.

SUMMARY OF THE INVENTION

Broadly, the present invention is a paper sheet holder for mounting on a surface such as a portable or laptop computer terminal with keyboard or other typing station including a base attachable to the surface, a mount base attached to or part of the base having hinge means upon which are adjustably mounted the paper holder unit comprised of corresponding curved front and back holder portions between which a sheet of paper is held in curved stand-up position for viewing.

It is a feature of the invention that the hinge means has racket means associated in it so that the paper holder unit can be adjusted to different angles.

DESCRIPTION OF THE PREFERRED EMBODIMENT

Figure 1:
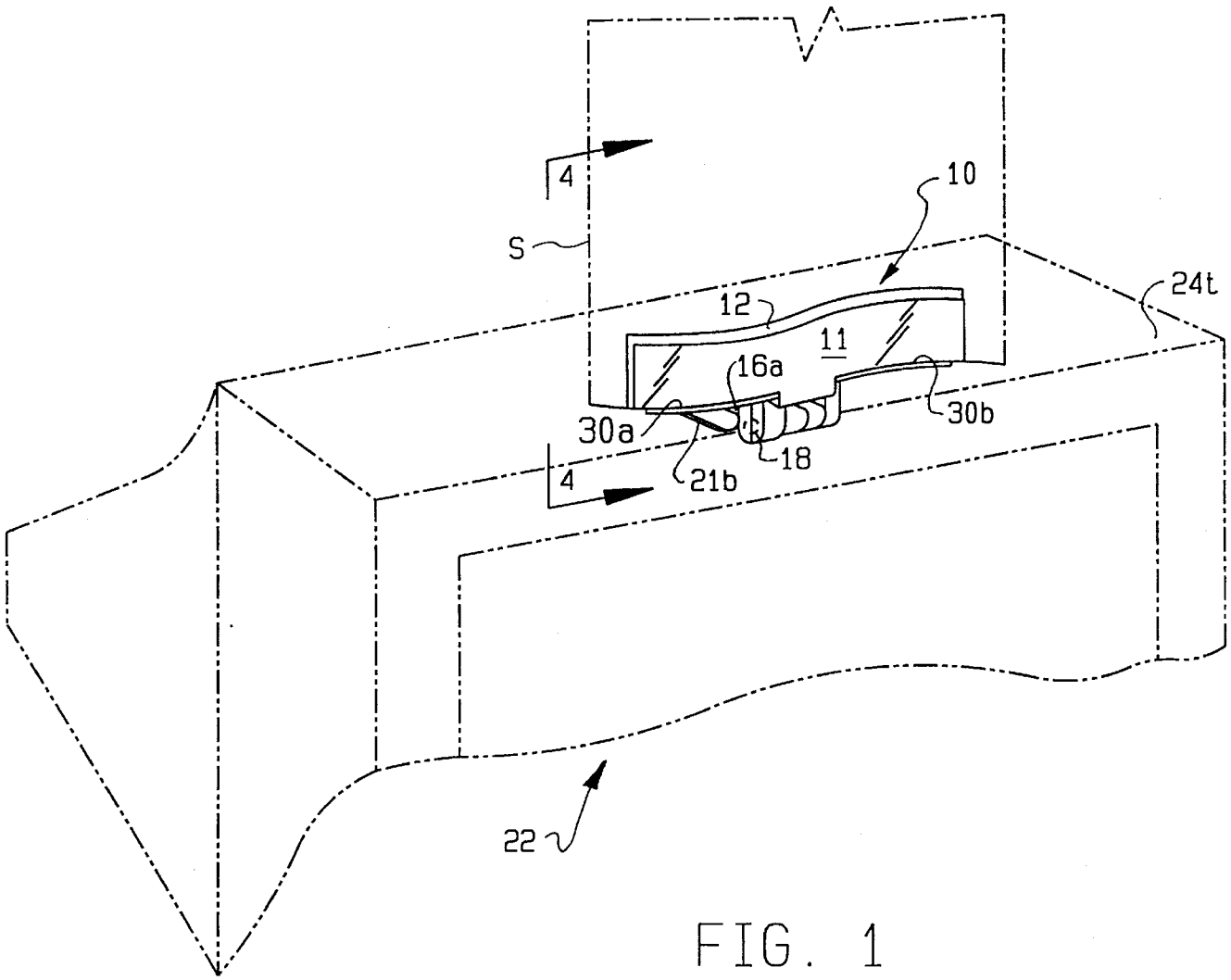
FIG. 1 is a perspective view of the copyholder positioned on a computer screen unit.

In the Figures, copyholder 10 includes front curved portion 11, rear curved portion 12 and support mount 16. Portions 11, 12 have S-shaped curves but other curves such as C-shaped may be used. Portion 12 has horizontal axis x—x. Portion 11 has a height of about 1.5 inches and a length of about seven (7) inches. Portion 11 which has a top edge 9*a* and a bottom edge 9*b* is the same size and shape of portion 12 and is preferably transparent. Support mount 16 includes sides 16*a*, 16*b*, neck 17 and axle mount 18. Side 16*b* has a section 21*a* of VELCRO brand hook and hoop material on it. Mount 16 is shown attached to complementary hook and loop section 21*b* on top surface 22*t* of computer screen unit 22. Normally planar paper sheet S is curved due to the curved shape of portions 11, 12, is shown to place each sheet in a standing position for viewing.

Figure 2:
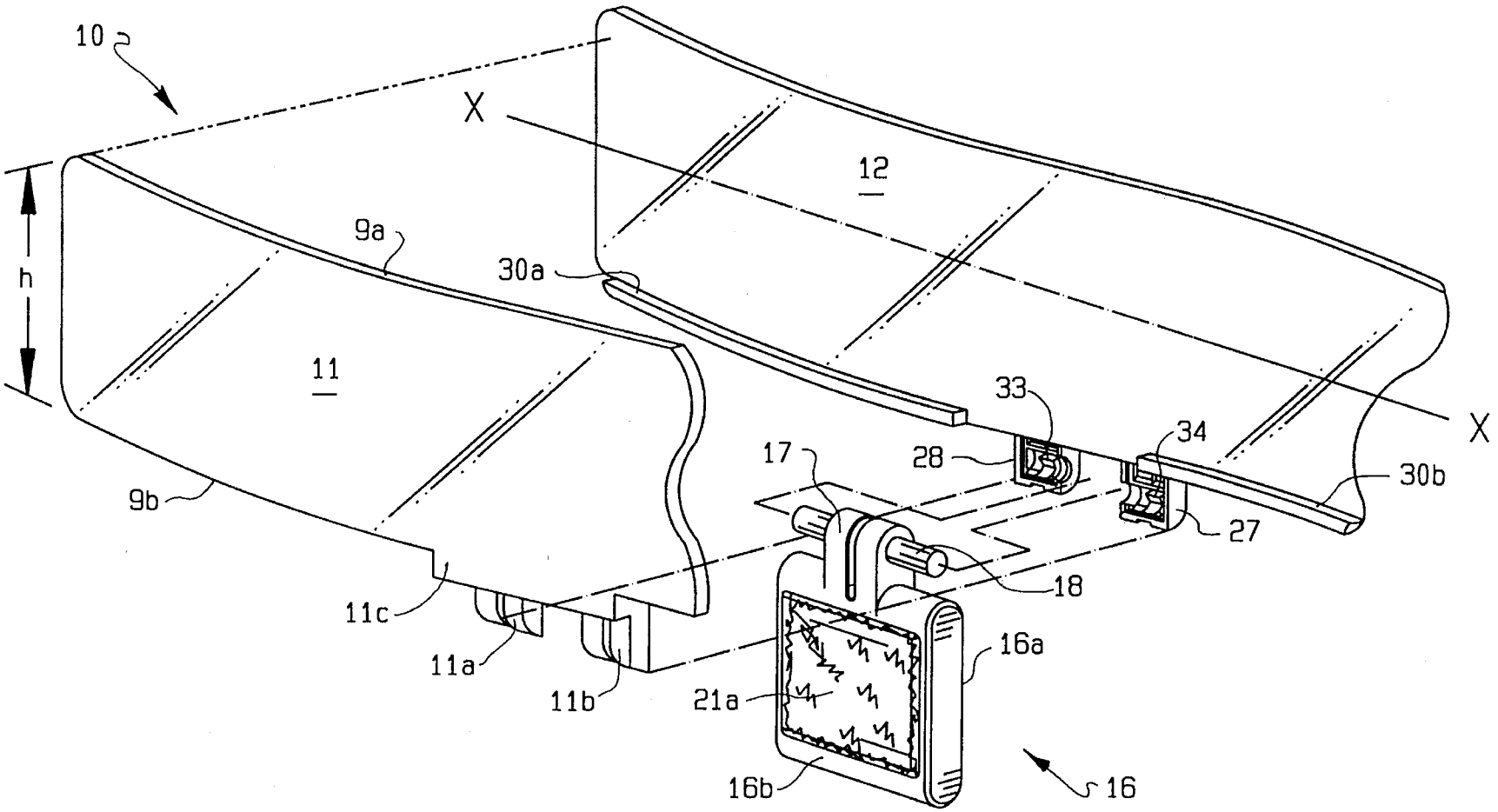
FIG. 2 is an exploded front perspective view of the copyholder.
Figure 3:
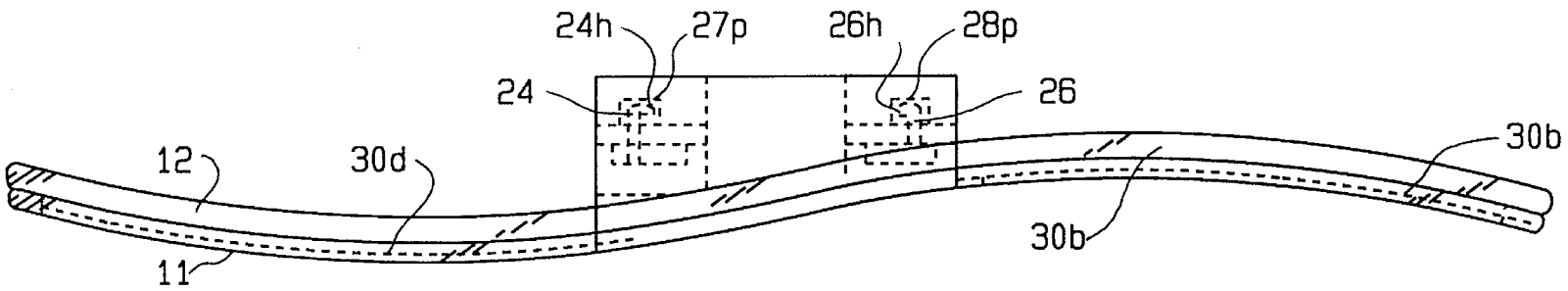
FIG. 3 is a plan view of the copyholder portions assembled and engaged.
Figure 5:
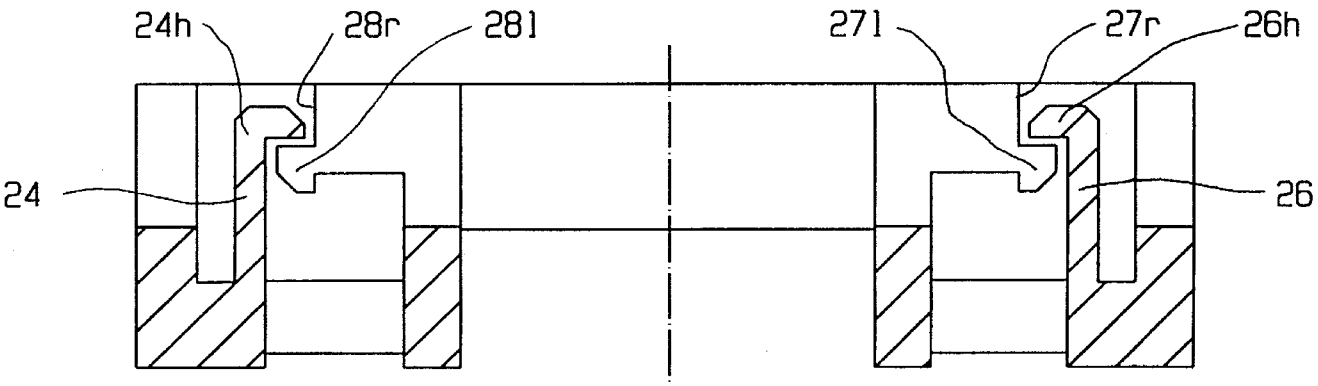
FIG. 5 is an enlarged view showing copyholder portion engagement means.
Figure 4:
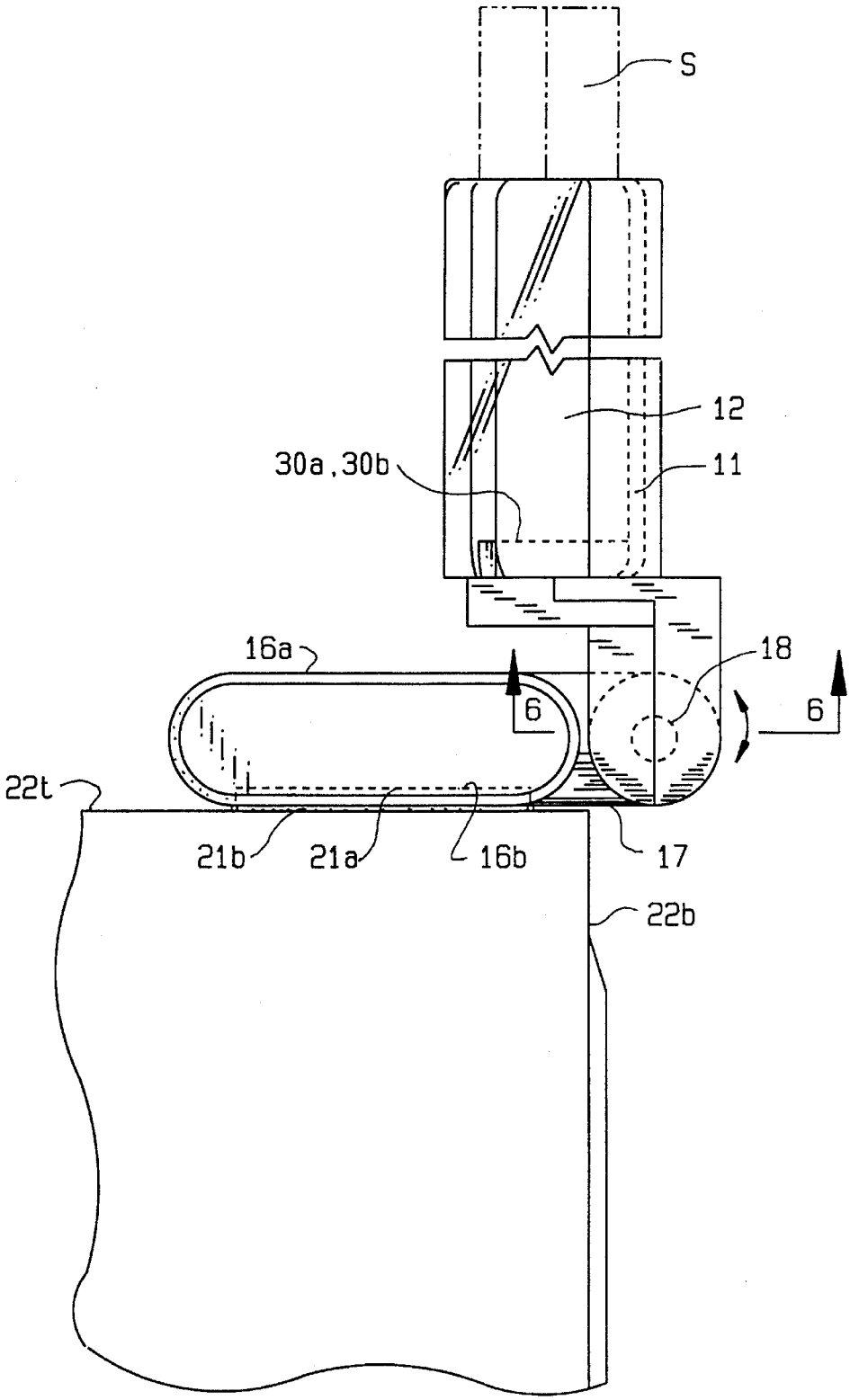
FIG. 4 is a sectional view taken along line 4—4 of FIG. 1.

Turning to FIGS. 2 and 3, front portion 11 has connector section 11*c* including two (2) depending connector fingers 11*a*, 11*b*. Fingers 11*a*, 11*b* each carry flexible projections 24, 26 with hooks 24*h*, 26*h*. Rear portion 12 carries depending receiver units 27, 28 which include recesses 27*r*, 28*r* (FIG. 5) into which are located hook engaging pieces 27*p*, 28*p*. Projections 24, 26 are assembled in the manufacture by snapping them into recesses 27*r*, 27*r* which include flexible lock extensions 27*l*, 28*l* (FIG. 5). Flexible projections 24, 26 and flexible lock extensions 27*l*, 28*l* are made of plastic or other flexible material so that they flex or deflect to permit engage of portions 11 and 12.

Figure 6:
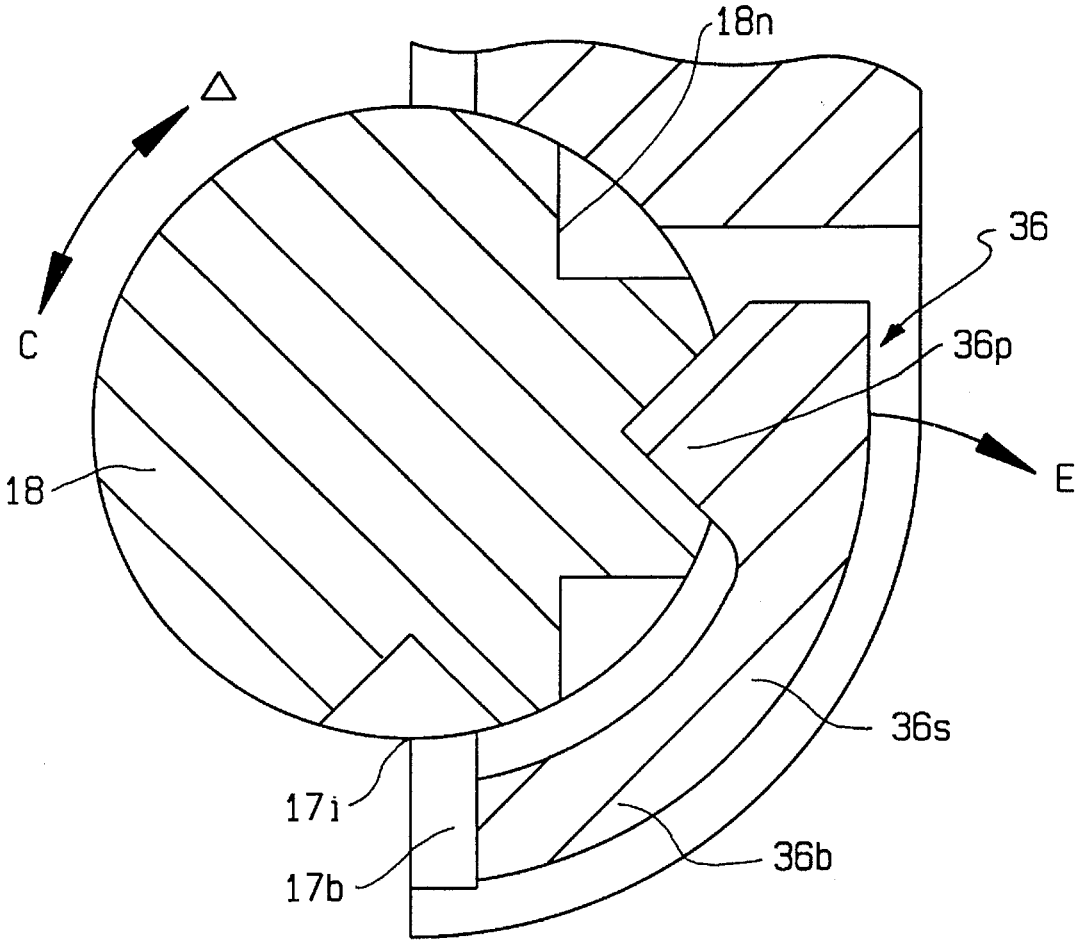
FIG. 6 is an enlarged view of the indexing means for holder mount.

Turning to FIG. 6, axle 18 rides C-shaped receivers 33, 34 in units 27, 28 of portion 12 and similar receivers (not shown) are in fingers 11*a*, 11*b* of portion 11. Axle 18 has a plurality of notches 18*n* with complementary flexible pawls 36 positioned in units 27, 28 capable of being engaged in selected notch 18n to place portions 11, 12 at the desired angle with respect to support mount 16. Each pawl 36 has base portions 36*b* mounted base piece 17*b*. Each pawl 36 also has stem portion 36*s* and projection portion 36*p*. When axle 18 is torqued in either direction C or D, projections 36*p* are urged out of the notches 18*n* in which they are located as pawl stem 36*s* bend in direction E and projections 36*p* then move into the adjacent notch 18*n*.

Turning back to FIG. 2, rear portion 12 included paper support shelves 30*a*, 30*b* spaced apart to receive connector section 11c so that portions 11, 12 are spaced apart about the thickness of a sheet or two of paper. The preferred spacing is the thickness of a sheet or two of paper. Shelves 30*a*, 30*b* prevent paper sheet S from falling down through the space between portions 11, 12. When portions 11 and 12 are connected as described above inside walls of portions 11 and 12 together with shelves 30*a*, 30*b* form a U-shaped paper receiving channel.

The space between portions 11 and 12 is small enough so that one or more sheet(s), depending on thickness, can be placed between portions 11 and 12 to accomplish a force fit or frictional fit such that the sheet(s) will not fall out when the copyholder 10 is mounted on non-level surfaces. Copyholder 10 may be mounted, for example, on a vertical surface with its axis x—x in a perpendicular orientation.

I claim:

1. A copyholder for mounting on a selected surface, comprising a base element for mounting the copyholder on such surface;

pivoting mount means connected to the base element; paperholder means for holding paper attached to the pivotal mount means which paperholder means in turn, comprises a first curved portion having a top edge and bottom edge and a surface area;

a second curved portion having a top edge and a bottom edge and a surface area of substantially the same size and shape as the surface area of the first portion; and connection means connecting the first and second portions together to form a paper receiving channel, said curved portions including a substantial distance between the top and bottom edges and being sufficiently flexible over such distance above the connection means to grip a sheet of paper through flexing.

2. The copyholder of claim 1 in which shelf means are positioned between the portions at the lower edges and the portions are slightly spaced apart to form a channel with a bottom.

3. The copyholder of claim 1 in which the first and the second curved portions are S-shaped.

4. The copyholder of claim 1 in which the base element is secured to the surface by fastening means and the pivotally mount means is secured to the base element by fastening means.

5. The copyholder of claim 3 in which the fastening means have hooks and loops.

6. The copyholder of claim 1 in which the base element and the pivotal mount means are connected together with pivotal hinge means.

7. The copyholder of claim 5 in which the hinge means comprises a racket means on a portion and a pivot axle on the mount means to permit positioning the portion selected angles to mount means.

8. The copyholder of claim 1 in which a curved portion is transparent.

* * * * *